US005100344A

United States Patent [19]

Truong

[11] Patent Number: 5,100,344

[45] Date of Patent: Mar. 31, 1992

[54] COAXIAL CONNECTOR WITH AEROMEDIAL DIELECTRIC

[75] Inventor: Matthew D. Truong, Elizabethtown, Pa.

[73] Assignee: Amp Incorporated, Harrisburg, Pa.

[21] Appl. No.: 750,675

[22] Filed: Aug. 27, 1991

Related U.S. Application Data

[63] Continuation of Ser. No. 674,488, Mar. 25, 1991, abandoned.

[51] Int. Cl.[5] ..... H01R 13/54

[52] U.S. Cl. ..... 439/578

[58] Field of Search ..... 439/578-585

[56] References Cited

U.S. PATENT DOCUMENTS 3,660,804 5/1972 Bebber, Jr. ..... 439/578

4,231,003 10/1980 Ishimaru ..... 439/578

4,659,156 4/1987 Johnescu et al. ..... 339/17 C 4,867,703 9/1989 Flanagan et al. ..... 439/578

FOREIGN PATENT DOCUMENTS 2626413 7/1989 France .

*Primary Examiner*—Joseph H. McGlynn

[57] ABSTRACT

A coaxial connector 1, comprises, a conductive electrical contact 25 concentrically encircled by an insulative dielectric body 23, and a conductive shell 22 concentrically encircling the body 23, the body 23 having a central hub 44 encircling the contact 25, an outer rim 43 engaging the shell 22, a space 45 concentrically between the hub 44 and the rim 43 containing atmospheric air, and webs 46 extending through the space and the atmospheric air supporting the rim 43 radially away from the hub 44.

9 Claims, 2 Drawing Sheets

COAXIAL CONNECTOR WITH AEROMEDIAL DIELECTRIC

This application is a continuation of application Ser. No. 07/674,488 filed Mar. 25, 1991, now abandoned.

FIELD OF THE INVENTION

The invention relates to coaxial electrical connectors and more particularly to a dielectric body that separates a conductive electrical contact from a concentrically encircling shell.

BACKGROUND OF THE INVENTION

U.S. Pat. No. 4,659,156 discloses a coaxial connector having a conductive electrical contact concentrically encircled by an insulative dielectric body, and a conductive shell concentrically encircling the dielectric body. A housing of the connector includes feet for engaging a circuit board, and metal mounting posts for connection in apertures of the circuit board. The characteristic impedance of the connector is fifty Ohms, primarily accounted for by the geometry and the dielectric constant of the materials fabricating the dielectric body.

French patent application 2,626,416 published July 28, 1989, discloses a coaxial connector having a characteristic impedance adjusted to approximately 75 Ohms by varying the relative diameter dimensions of the electrical contact, the shell and the insulative or dielectric materials.

SUMMARY OF THE INVENTION

The invention resides in a dielectric body of a coaxial connector that contains substantial atmospheric air for adjusting the characteristic impedance of a coaxial connector. A medial portion of the dielectric body contains open space for atmospheric air. Webs of the dielectric body extend from a hub through the open space to support a rim radially spaced from the hub. Because the medial portion is substantially attributed to atmospheric air in an open space of the medial portion, the dielectric body is a body comprised of an aeromedial dielectric.

The invention will now be described by way of example with reference to a detailed description taken in conjunction with accompanying drawings.

DESCRIPTION OF THE INVENTION

Figure 1:
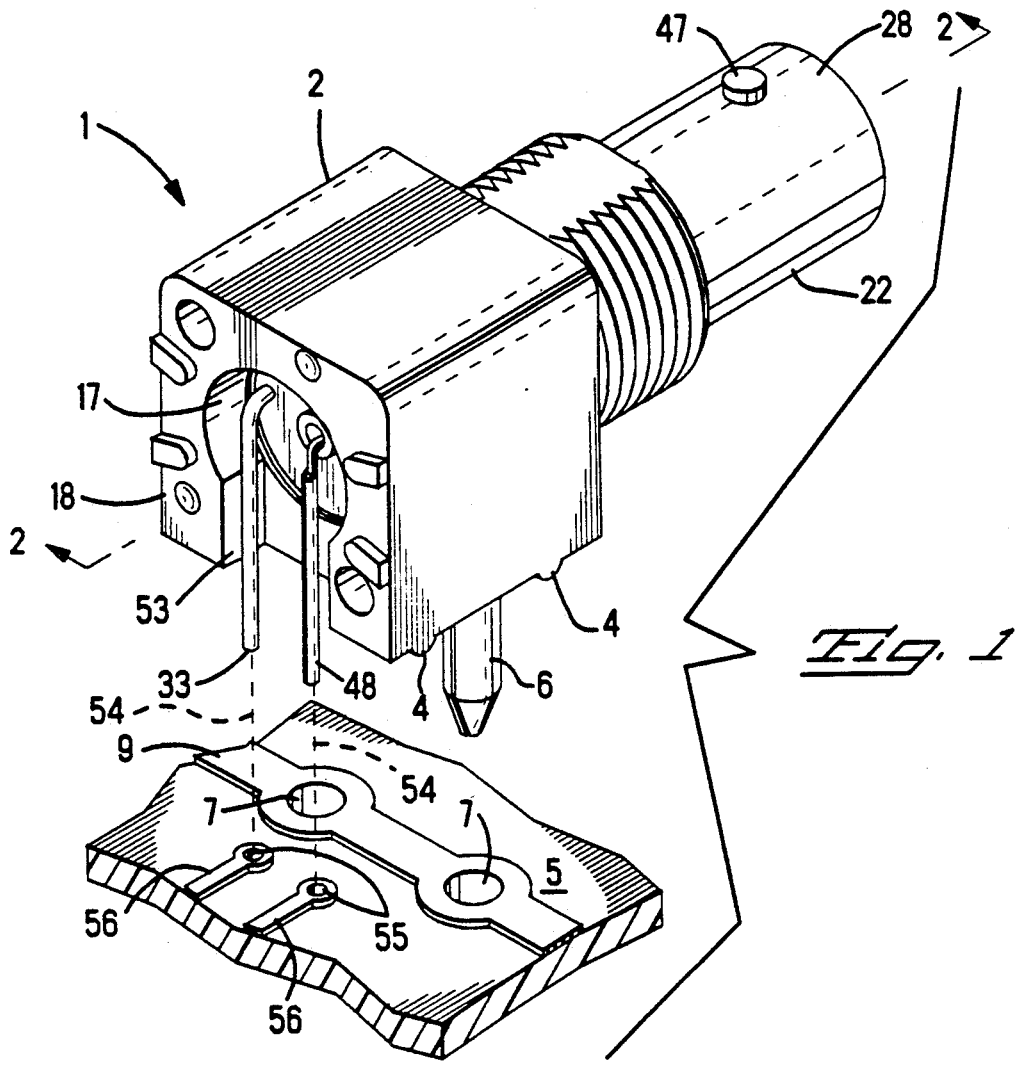
FIG. 1 of the drawings is a perspective view of an improved connector according to the invention and a portion of a printed circuit board with which the connector is to be assembled.
Figure 2:
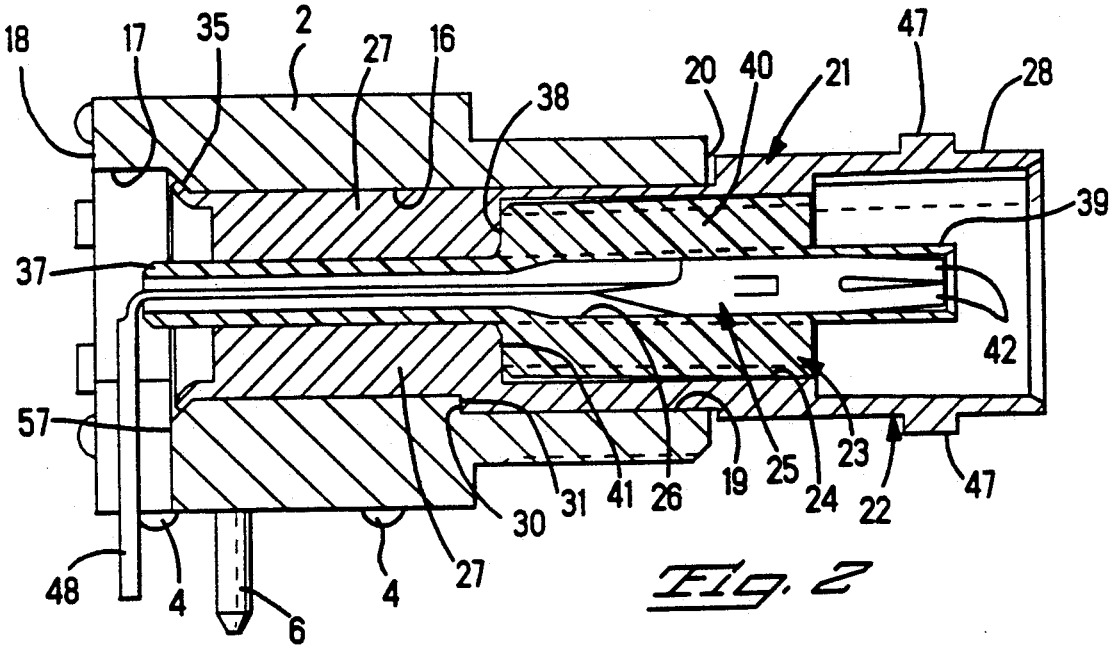
FIG. 2 is a section view of the improved connector and taken along the line 2—2 of FIG. 1.
Figure 3:
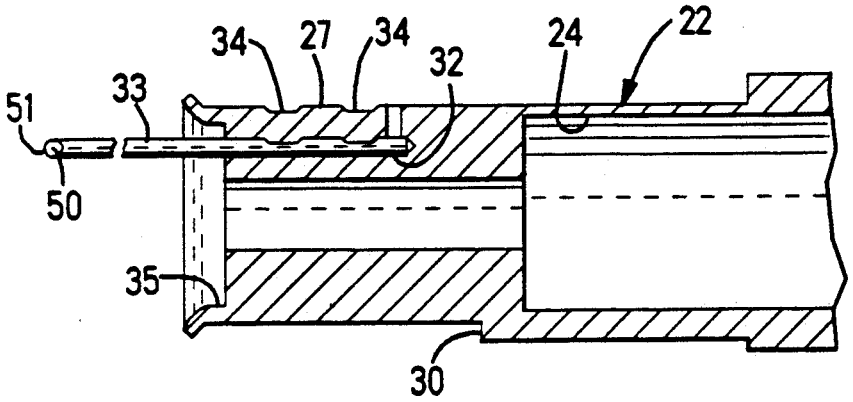
FIG. 3 is an enlarged section view of a portion of the connector shown in FIG. 1.

A detailed description of the invention follows with reference numerals in the detailed description shown in the drawings. FIGS. 1 through 3 show an improved connector 1 according to the invention. A housing 2 of the connector 1 is molded from dielectric material and has a base 3 and integral projecting feet 4 on which the housing 2 stands when the base 3 is mounted on a printed circuit board 5.

Figure 4:
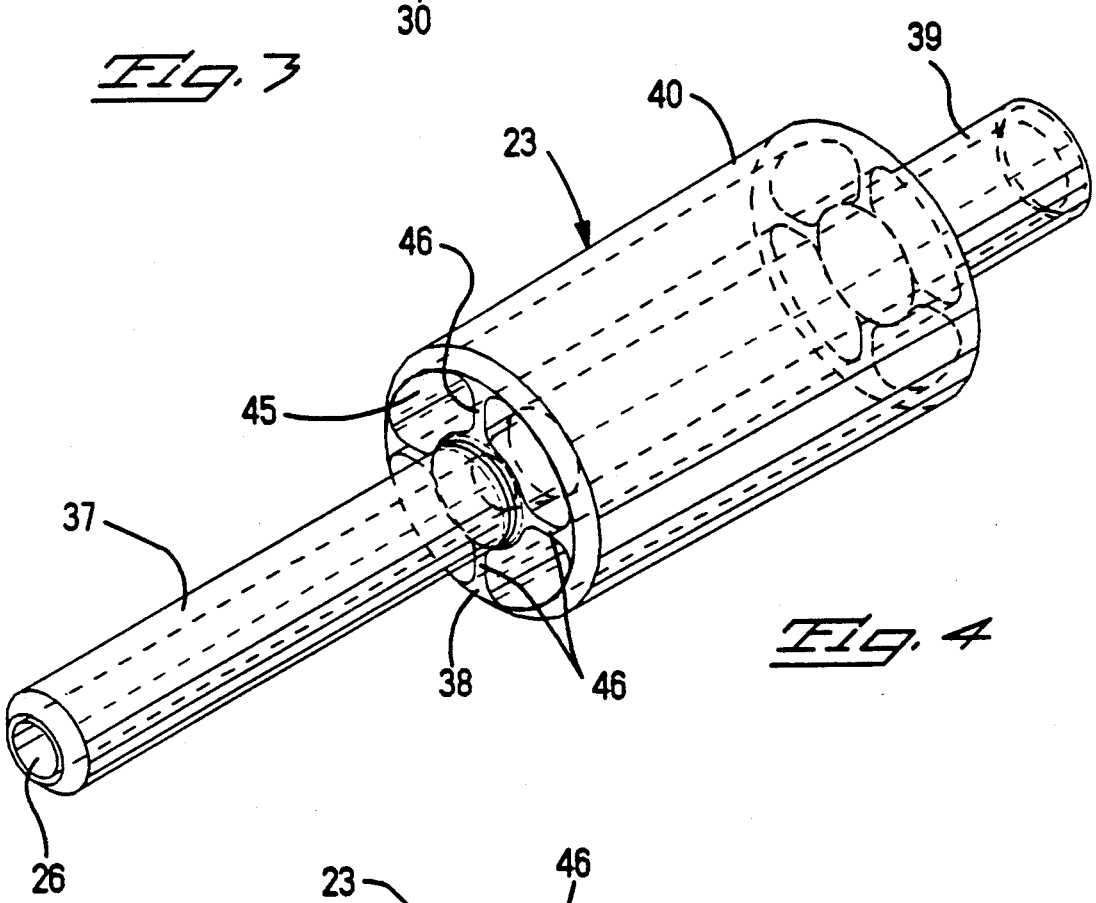
FIG. 4 is a perspective view of a dielectric body of the connector shown in FIG. 2.
Figure 5:
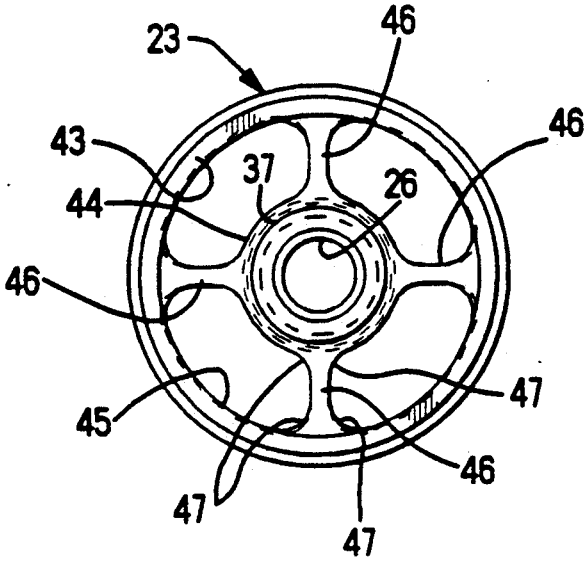
FIG. 5 is an end view of the dielectric body shown in FIG. 4.

The connector 1 has projecting mounting posts 6 of conductive metal for connection in respective apertures 7 through the thickness 8 of the printed circuit board 5. The apertures 7 are lined with metal plating and the plating also forms a conductive circuit 9 on the printed circuit board 5. As shown in FIG. 4, each mounting post 6 has a roughened surface on an end portion 10 that is frictionally retained with an interference fit within a corresponding recess 11 in the base 3. The longitudinal axis 12 of each mounting post is aligned with the center line 13 of the corresponding aperture 7. Each mounting post 6 has a frusto-conical taper 14 toward the free end 15 and sloped at an angle of thirty-five degrees with the axis 12. The taper 14 and the alignment of the mounting post 6 with a corresponding aperture 7 facilitates registration of the post 6 in the aperture 7 by automated machinery, not shown.

The housing 2 has a bore 16 with an axis parallel to the base 3. The bore 16 has an enlarged diameter end bore portion 17 communicating with a rearward end 18 of the housing 2, and an enlarged diameter end bore portion 19 communicating with a forward end 20 of the housing 2.

A coaxial connector assembly 21 is in the bore 16 and comprises a conductive outer shell 2, a dielectric body 23 of insulative material within a hollow interior 24 of the outer shell 22 and a conductive center contact 25 within a stepped bore 26 extending axially through the length of the dielectric body 23. A rearward end 27 of the outer shell 22 is of smaller diameter than the forward end 28 and is assembled in the bore 16 of the housing 2 from the forward end 29 of the housing 2. A shoulder 30 on the outer shell 22 engages a shoulder 3 at the intersection of the end bore portion 17 and the bore 16 of the housing 2 to limit movement of the outer shell 22 in a rearward direction.

As shown in FIG. 3, the rearward end 27 of the outer shell 22 has a recess 32 in which is mounted an elongated and conductive electrical contact portion 33 that projects axially from the rearward end 27 of the outer shell 22 and from the rearward end 18 of the housing 2 that surrounds the outer shell 22 and the contact 33. The contact portion 33 is secured in place by applying compression on the outer shell 22 and causing two indentations 34 of the outer shell 22 and partial collapse of the outer shell 22 in compression engagement against the contact portion 33. A skirt 35 on the rearward end 27 is then flared radially outward to engage a shoulder 36 at the intersection of the end bore portion 17 and the bore 16 of the housing 2 to limit movement of the outer shell 22 in a forward direction.

A smaller diameter rearward end 37 of the dielectric body 23 is inserted in and along the open forward end 28 of the outer shell 22 and projects outwardly of the rearward end 27 of the outer shell 22 to be surrounded by the outer housing 2. A shoulder 38 on the forward end 40 of larger diameter of the dielectric body 23 engages a shoulder 41 in the bore 16 of the outer shell 22 to limit movement of the dielectric body 23 in a rearward direction. A unitary socket portion 39 projects forwardly of the forward end 40. The socket portion 39 is hollow with an open forward end.

The center contact 25 has a forward portion in the form of resilient fingers 42 in the socket portion 39 for electrical connection and coupling to a center contact of a known coaxial connector. Further details of the known coaxial connector are disclosed in U.S. Pat. No. 4,165,911 issued Aug. 28, 1979. The center contact 25 has a rearward extending, and elongated contact portion 48 which is inserted in and along the bore 26 of the dielectric body 23 and which projects outwardly of the rearward end 37 of the dielectric body 23 and the rearward end 18 of the housing 2.

Each of the contact portions 33 and 48 has a corresponding taper 50 toward the corresponding free end. An apex 51 of the taper 50 at the free end intersects and is coincident with a longitudinal edge 52 of the corresponding contact portion. As shown in FIGS. 1 and 4, the rearward end 18 of the housing 2 is provided with channels 53 aligned with respective contact portions 33, 48 and communicating with the base 3 and the bore 16. The contact portions 33, 48 are bent toward the base 3 and are received in respective channels 53. The free ends of the contact portions 33, 48 project from the channels 53 and the base 3. The apecies 51 of the tapers 50 are in alignment with the center lines 54 of respective apertures 55 through the thickness 8 of the printed circuit board 5. The apertures 55 are lined with conductive plating for engaging and establishing electrical connection with the contact portions 33, 48. The plating further forms conductive circuits 56 on the printed circuit board 5. The longitudinal edges 52 of the contact portions 33, 48 engage the bottom walls 57 of the channels 53 which are also aligned with the center lines 54 of the respective apertures 55.

The dielectric body 23 is of unitary construction with the forward end 40 provided with an outer, solid rim 43 concentrically encircling and spaced radially from a solid hub 44. The hub 44 concentrically encircles the bore 26 and the electrical center contact 25 in the bore 26. The rim 43 and the hub 44 are separated by a space 45 concentrically between the hub 44 and the rim 43. For ease in molding the dielectric body 23, the space 45 communicates with opposite, front and rear ends of the forward end 40. Multiple thin webs 46 extend radially from the hub 44 to the rim 43 and support the rim 43 radially away from the hub 44. The webs 46 intersect the rim 43 and the hub 44 at rounded corner edges 47 extending in a direction axially lengthwise or longitudinally along the length of the dielectric body 23. The webs 46 extend through the open space 45 and the atmospheric air contained in the space 45. The volume of atmospheric air in the space 45 exceeds the combined volume of the dielectric material of the rim 43, hub 44 and webs 46. The space 45 extends radially between the rim 43 and the hub 44 through a medial portion of the dielectric body 23. Because the medial portion is substantially attributed to atmospheric air in an open space of the medial portion, the dielectric body 23 is an aeromedial dielectric body. The rim 43 is supported against the interior of the shell 22, and the hub 44 is supported against the contact 25 concentrically of the shell 22. The invention allows adjustment of the characteristic impedance of the connector 1 by increasing the volume of air while maintaining the mechanical strength of the dielectric body 23 that is required to support the center contact concentrically in the shell 22.

I claim:

1. A coaxial connector, comprising: a conductive electrical contact concentrically encircled by an insulative dielectric body, and a conductive shell concentrically encircling the body, the body having a central hub encircling the contact, an outer rim engaging the shell, a space concentrically between the hub and the rim containing atmospheric air, and webs surrounded by the space and the atmospheric air supporting the rim radially away from the hub.

2. A coaxial connector as recited in claim 1, and further comprising: the webs extend radially from the hub through the concentric space.

3. A coaxial connector as recited in claim 1, and further comprising: a rearward end of the dielectric body projecting from the hub and being of smaller diameter than the rim.

4. A coaxial connector as recited in claim 1, and further comprising: a rearward end of the dielectric body projecting from the hub and being of smaller diameter than the rim, the webs extending radially further than the diameter of the rearward end.

5. A coaxial connector as recited in claim 1, and further comprising: the webs intersecting the rim and the hub at rounded corner edges extending axially along the length of the dielectric body.

6. A coaxial connector, comprising: a conductive shell and a conductive electrical contact separated concentrically by a dielectric body having a first volume, and a second volume of atmospheric air in a space between inner and outer concentric diameters of the body, wherein the volume of atmospheric air exceeds the volume of the body.

7. A coaxial connector as recited in claim 6 wherein, at least a portion of the body has front and rear ends, and the space communicates with the front and rear ends.

8. A coaxial connector as recited in claim 6 wherein, the body includes: a hub receiving the contact, a rim engaging the shell, and webs intersecting the hub and the rim.

9. A coaxial connector as recited in claim 8 wherein, the webs intersect the hub and the rim at rounded corner edges.

* * * * *